US010036391B2

(12) United States Patent
Yeh

(10) Patent No.: US 10,036,391 B2
(45) Date of Patent: Jul. 31, 2018

(54) FAN AND IMPELLER THEREOF

(71) Applicant: DELTA ELECTRONICS, INC., Kuei San, Taoyuan Hsien (TW)

(72) Inventor: Shir-Harn Yeh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 785 days.

(21) Appl. No.: 14/037,905

(22) Filed: Sep. 26, 2013

(65) Prior Publication Data

US 2014/0363296 A1 Dec. 11, 2014

(30) Foreign Application Priority Data

Jun. 7, 2013 (CN) ..... 2013 1 0225683

(51) Int. Cl.

| | |
|---|---|
| ***F01D 5/16*** | (2006.01) |
| ***F04D 19/00*** | (2006.01) |
| ***F04D 25/06*** | (2006.01) |
| ***F04D 29/66*** | (2006.01) |

(52) U.S. Cl.

CPC ..... *F04D 19/002* (2013.01); *F04D 25/064* (2013.01); *F04D 29/662* (2013.01)

(58) Field of Classification Search

CPC ..... F04D 29/66; F04D 29/661; F04D 29/662; F04D 29/668; F04D 25/088; F04D 25/0613; F04D 19/002; F04D 29/26; F04D 29/325; F04D 29/329; F04D 29/281; F04D 25/064

USPC ..... 416/144, 145

See application file for complete search history.

(56) References Cited

U.S. PATENT DOCUMENTS

| | | | | |
|---|---|---|---|---|
| 5,574,321 | A * | 11/1996 | Baker | F04D 25/08 310/179 |
| 6,213,717 | B1 * | 4/2001 | Bucher | F04D 25/088 415/119 |
| 7,034,418 | B2 * | 4/2006 | Matsumoto | F04D 25/0613 165/121 |
| 7,063,507 | B2 * | 6/2006 | Hsieh | F04D 29/662 415/119 |
| 7,281,896 | B2 * | 10/2007 | Yu | F04D 29/329 416/144 |
| 7,927,074 | B2 * | 4/2011 | Sun | F04D 29/646 416/144 |
| 2011/0236211 | A1 * | 9/2011 | Schneider | F04D 29/662 416/144 |
| 2012/0177515 | A1 * | 7/2012 | Schmid | F04D 29/662 417/423.14 |

* cited by examiner

*Primary Examiner* — Kenneth Bomberg
*Assistant Examiner* — Julian Getachew
(74) *Attorney, Agent, or Firm* — Muncy, Geissler, Olds & Lowe, P.C.

(57) ABSTRACT

An impeller of a fan comprises a hub, a plurality of blades, a permeable shell and a permanent magnet. The hub includes a top portion and a side wall, and the inside of the top portion adjacent to the side wall includes a plurality of first balance rooms. The blades are disposed around the hub. The permeable shell is disposed within the hub. The permanent magnet is disposed within the permeable shell, and at least a portion of the first balance room is defined between the top portion and the permanent magnet. A fan is also disclosed.

14 Claims, 8 Drawing Sheets

FAN AND IMPELLER THEREOF

CROSS REFERENCE TO RELATED APPLICATIONS

This Non-provisional application claims priority under 35 U.S.C. § 119(a) on Patent Application No(s). 201310225683.6 filed in People's Republic of China on Jun. 7, 2013, the entire contents of which are hereby incorporated by reference.

BACKGROUND OF THE INVENTION

Field of Invention

The invention relates to a fan and, in particular, to an impeller of a fan.

Related Art

With the raised requirement of the heat dissipation for systems, more and more fans with different sizes are utilized. A fan on the operation can induce an airflow to take away the heat generated by an object. For a general fan structure, a plurality of blades are disposed on the periphery of the hub of the fan and can rotate to cause an airflow. However, if the center of gravity of the fan is shifted from the fan's center, the fan's vibration or shaking will occur.

The above-mentioned vibration or shaking not only causes the fan to generate noises but also makes the fan shaft fatigue more easily and rapidly, and therefore the lifespan of the fan will be reduced or the heat dissipation efficiency will deteriorate so that the product quality of the fan is reduced. The current solution for this problem is to dispose a plurality of balance rooms in the impeller of the fan. FIG. 1 is a schematic diagram showing some balance rooms of the impeller of a conventional fan. As shown in FIG. 1, the conventional impeller 1 includes a plurality of recesses 11 disposed at the top portion 12 of the impeller 1. Some objects are disposed in the recesses 11 for functioning as balance elements 13, such as weights, and thus the impeller can be balanced on the fan's operation in the manner of adding weight. However, when the fan is operated, the added balance elements 13 may fly out and leave the recesses 11 due to the inertia force. Therefore, the fan will lose the balance effect, and thus the overmuch vibration caused by the fan's operation will further deteriorate the fan's quality. Besides, in the prior art, an additional mold is required for the balance elements 13 for assuring the balance element 13 and the recess 11 of a tight fit therebetween to avoid the separation of the balance element 13 from the recess 11 on the fan's operation. Besides, the exposed recesses 11 also affect the fans' characteristic and the dust will be accumulated in the recesses.

SUMMARY OF THE INVENTION

In view of the foregoing subject, an objective of the invention is to provide a fan and an impeller thereof that can be balanced on the operation and also can avoid the accumulation of dust for enhancing the fan's efficiency and characteristic, and the fineness requirement for the fit between the balance element and the balance room can be reduced for simplifying the manufacturing process.

To achieve the above objective, an impeller of a fan according to the invention comprises a hub, a plurality of blades, a permeable shell and a permanent magnet. The hub includes a top portion and a side wall, and the inside of the top portion adjacent to the side wall includes a plurality of first balance rooms. The blades are disposed around the hub.

The permeable shell is disposed within the hub. The permanent magnet is annularly disposed within the permeable shell, and at least a portion of the first balance room is defined between the top portion and the permanent magnet.

In one embodiment, the hub further includes a plurality of first partitions disposed inside the top portion and adjacent to the side wall, and the first partitions define the first balance rooms.

In one embodiment, the first partitions are extended from the top portion to withstand or engage the permeable shell.

In one embodiment, the hub further includes a plurality of second partitions disposed at the end of the side wall away from the top portion to define at least a second balance room.

In one embodiment, the impeller further comprises a balance object disposed in the first balance rooms and/or the second balance rooms.

In one embodiment, each of the first partition and second partition is a rib or a cup-like structure.

In one embodiment, the hub and the permeable shell are integrated as a single piece by an injection molding.

In one embodiment, the top portion includes a plurality of recesses separately disposed, the permeable shell includes a plurality of openings corresponding to the recesses, and the recesses and the openings define the first balance rooms.

To achieve the above objective, a fan according to the invention comprises an impeller, a motor and a frame. The impeller comprises a hub, a plurality of blades, a permeable shell and a permanent magnet. The hub includes a top portion and a side wall, and the inside of the top portion adjacent to the side wall includes a plurality of first balance rooms. The blades are disposed around the hub. The permeable shell is disposed within the hub. The permanent magnet is disposed within the permeable shell, and at least a portion of the first balance room is defined between the top portion and the permanent magnet. The motor is coupled to the impeller for driving the impeller to rotate. The frame is for receiving the impeller and the motor therein.

As mentioned above, in the fan and impeller thereof according to the invention, a plurality of first balance rooms are disposed on the inside of the top portion of the hub adjacent to the side wall, and thus hidden on the inside of the top portion of the hub. In comparison with the prior art where the balance rooms are exposed, the accumulation of dust can be avoided in the invention. Besides, the outer edge of the hub is kept complete so that the fan's operation can cause a smoother airflow field. Furthermore, the permanent magnet is annularly disposed within the permeable shell and partially covers the first balance room, and thereby the balance object disposed in the first balance room can be fixed between the hub and the permanent magnet. So, the balance object will not fall off during the fan's operation and thus the stability of the fan's operation can be kept. Besides, the balance object can be further fixed by the disposition of the permanent magnet and the centrifugal force caused by the fan's operation.

In the embodiment where the hub has a thinner wall, the first balance room can be formed by the first partitions, so that the hub and the permeable shell needn't have recesses to form the first balance room. Therefore, the hub and the permeable shell can be kept the structural completeness. In the embodiment where the hub has a thicker wall, the dimensions of the first balance room can be adjusted to get more capacity, and this will not be affected by the position of the permanent magnet.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
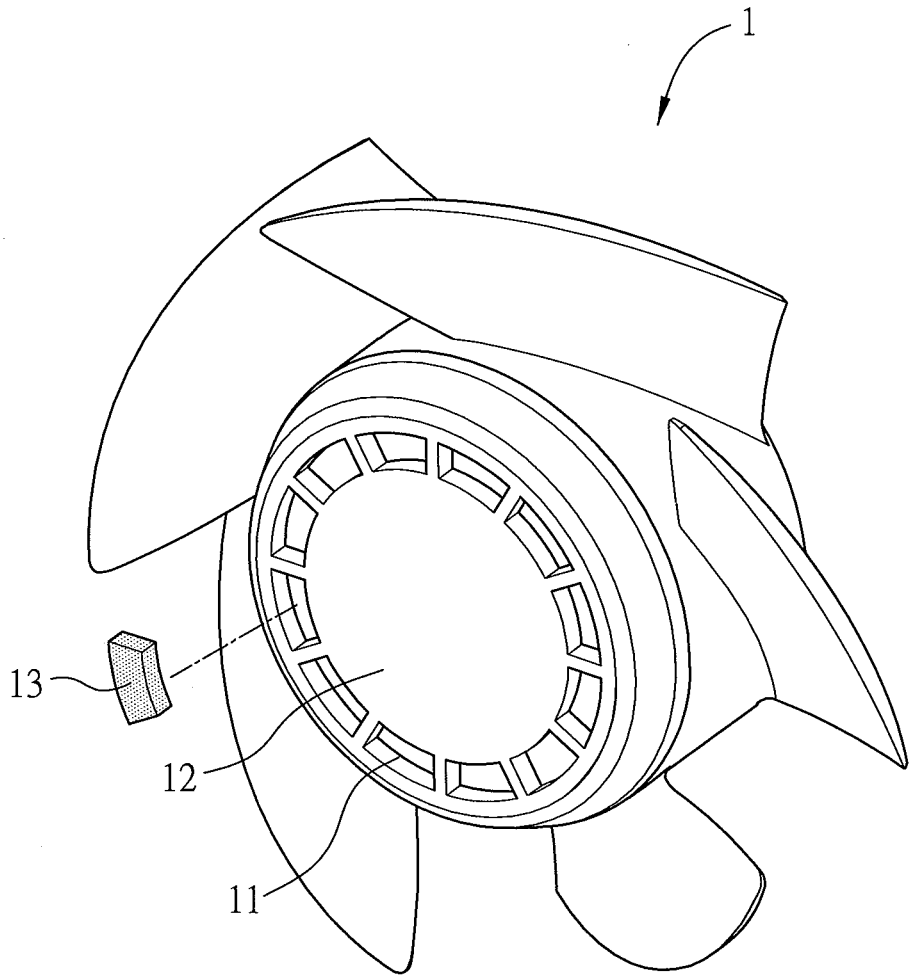
FIG.1 (Prior Art)
FIG. 1 is a schematic diagram showing the disposition of the balance rooms in a conventional impeller.
Figure 2:
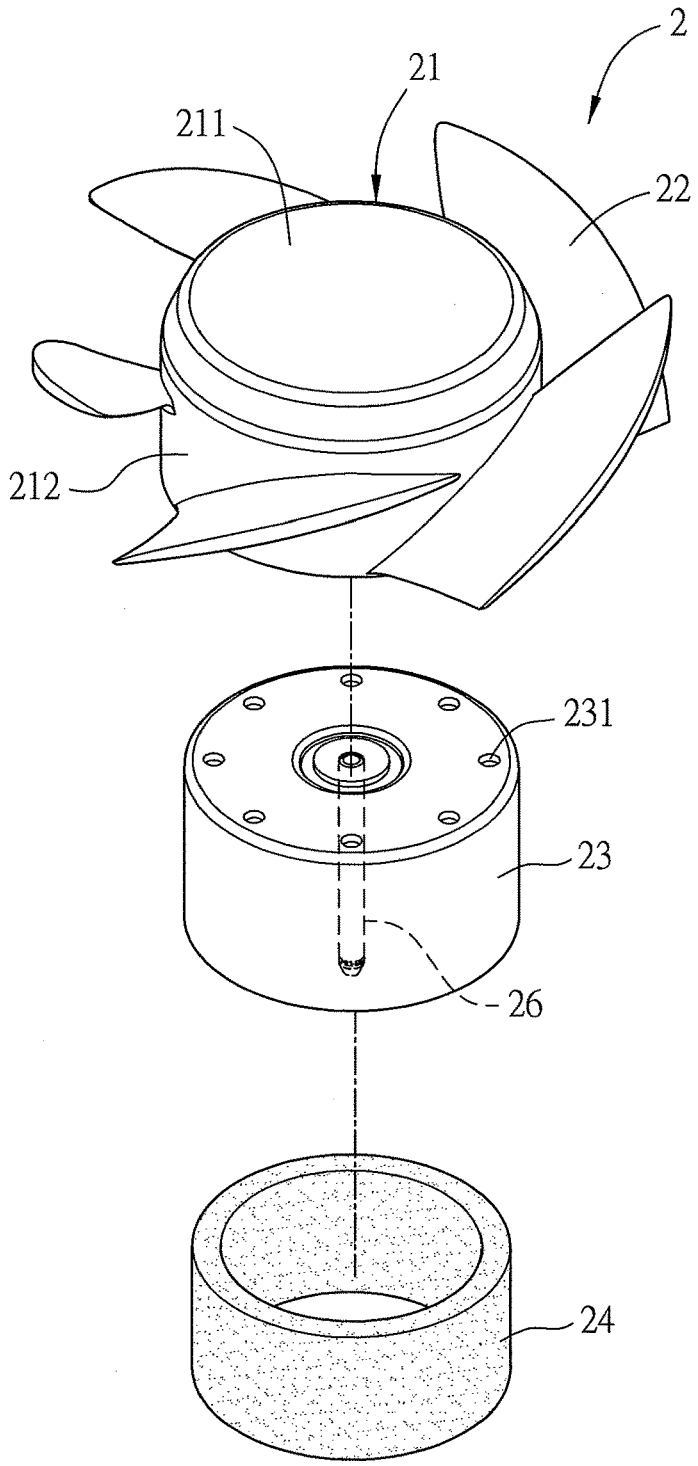
FIG. 2 is an exploded diagram of an impeller according to a first embodiment of the invention.
Figure 3:
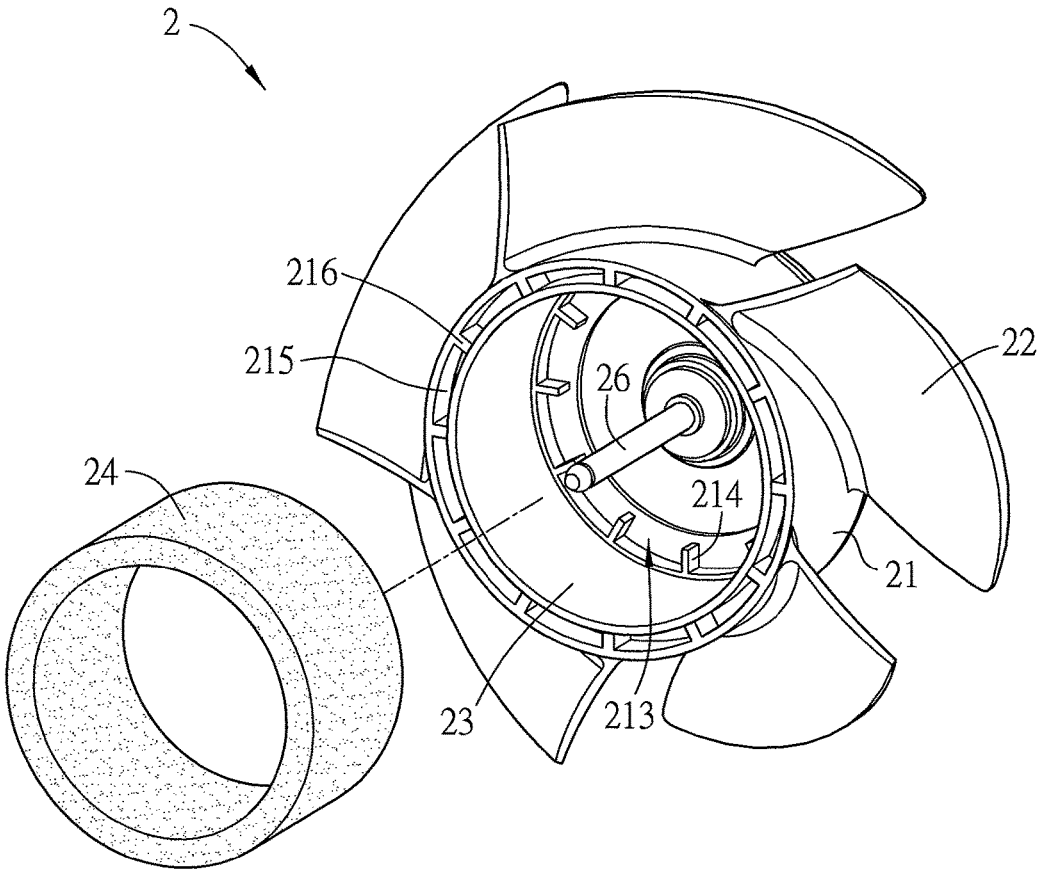
FIG. 3 is a schematic diagram of the hub and the permanent magnet in FIG. 2.
Figure 4:
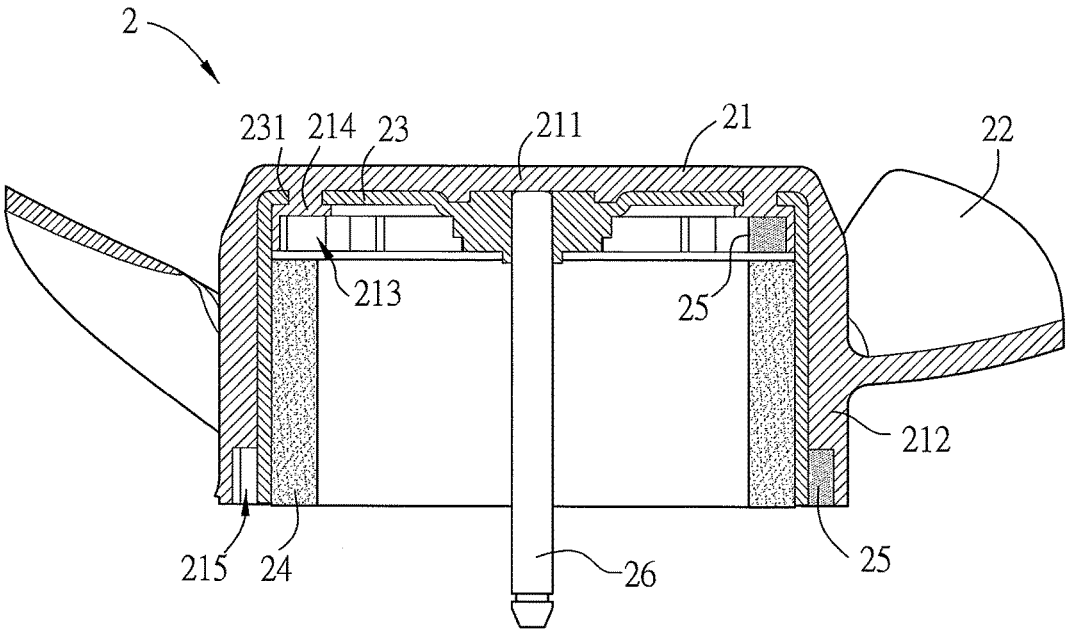
FIG. 4 is a sectional diagram of the impeller in FIG. 2.

FIG. 2 is an exploded diagram of an impeller according to a first embodiment of the invention, and FIG. 3 is a schematic diagram of the hub and the permanent magnet in FIG. 2. As shown in FIGS. 2 and 3, the impeller 2 includes a hub 21, a plurality of blades 22, a magnetically permeable shell 23 and a permanent magnet 24. The hub 21 includes a top portion 211 and a side wall 212, and the blades 22 are disposed around the side wall 212. The inside of the top portion 211 adjacent to the side wall 212 includes a plurality of first balance rooms 213. In this embodiment, the hub 21 includes a plurality of first partitions 214, which are separately disposed inside the top portion 211 adjacent to the side wall 212 to define the first balance rooms 213. The first balance elements 214 are, for example but not limited to, ribs or cup-like structures. In detail, the permeable shell 23 is disposed inside the top portion 211 and the side wall 212. When the permeable shell 23 is disposed in the hub 21, the first partitions 214 extending from the top portion 211 withstand or engage the permeable shell 23. Preferably, the hub 21 and the permeable shell 23 are integrated as one single piece in a two-material way, such as an injection molding where a plastic material (as the hub 21) covers the permeable shell 23 to form the one-piece structure. FIG. 4 is a sectional diagram of the impeller in FIG. 2. As shown in FIGS. 2 and 4, the permeable shell 23 further includes a plurality of injection holes 231 to allow the plastic material to be injected therein so that the hub 21 is formed inside and outside the permeable shell 23. In detail, the top portion 211 is formed outside the permeable shell 23 while the first partitions 214 extending from the top portion 211 are disposed inside thereof. Thus, the first partitions 214 are formed by injection molding.

In this embodiment, because the first balance rooms 213 are formed by the first partitions 214 separately disposed, the hub 21 with a thinner wall still can be used herein. The permeable shell 23 can be configured with the injection hole 231 as small as sufficient to allow the plastic material to pass therethrough, so the structural completeness of the permeable shell 23 can be kept sufficiently. In other embodiments, the hub and the permeable shell can be made of separated parts instead of one-piece structure. For example, the top portion of the permeable shell has a plurality of holes to allow the first partitions to pass therethrough for the tight fit therebetween. In this embodiment, because the hub 21 is unnecessarily configured with the recess or hole, the top portion thereof can be made as a complete structure without any opening. In comparison with the conventional hub with recesses, the hub of the invention can avoid the accumulation of dust and thus the fan's operation can cause a smoother airflow field.

Figure 5:
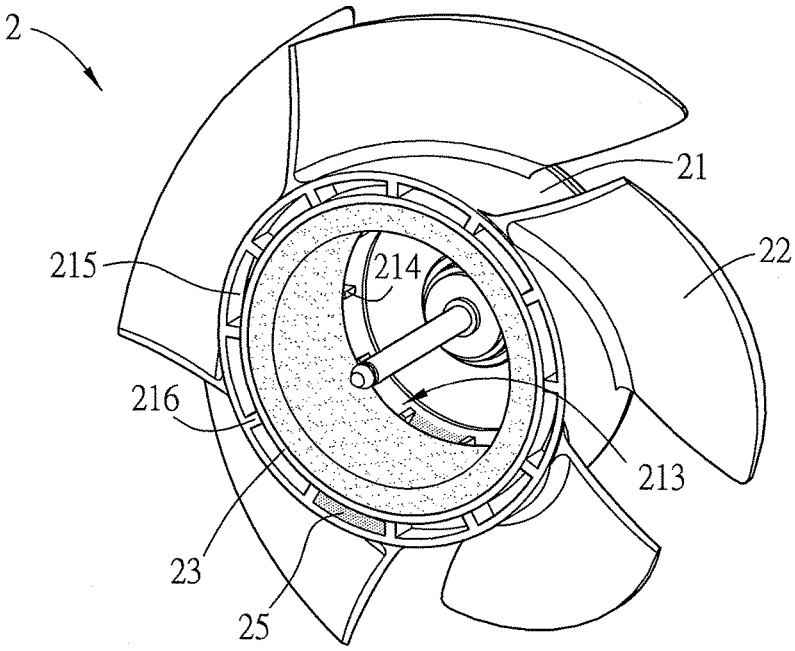
FIG. 5 is a schematic diagram of the impeller in FIG. 2.

FIG. 5 is a schematic diagram of the impeller in FIG. 2. As shown in FIGS. 4 and 5, the permanent magnet 24 is disposed within the permeable shell 23, and at least one portion of the first balance room 213 is limited between the top portion 211 and the permanent magnet 24. In other words, the permanent magnet 24 partially covers the first balance room 213. When the impeller 2 is applied to a fan, the impeller 2 can further include at least a balance object 25 disposed in the first balance room 213 for further balancing and smoothing the fan's operation. Generally, since the vibration due to the unbalanced operation of the fan mainly occurs in the portion of uneven weight distribution, the balance object 25 can be disposed in the first balance room 213 that is adjacent to the lighter portion to achieve the balanced operation of the fan. Otherwise, the balance objects with the same weight can be disposed in the all first balance rooms, and then the balance object disposed in the heavier portion can be reduced in weight so that the balanced operation of the fan can be also achieved. The balance object 25 is, for example but not limited to, balance soil or a balance element, and the balance soil is preferable. To be noted, for the clear figure, only one balance object 25 disposed in the first balance room 213 is shown, but the invention is not limited thereto. Because the permanent magnet 24 is disposed within the permeable shell 23, the balance object 25 disposed in the first balance room 213 is retained or secured between the hub 21 and the permanent magnet 24. Thereby, the balance object 25 will not leave the hub 21 on the fan's operation and thus the stability of the operation can be kept.

Besides, the hub 21 can further include a plurality of second balance rooms 215 disposed at the end of the side wall 212 away from the top portion 211. Similarly, the hub 21 further includes a plurality of second partitions 216 which are separately disposed at the end of the side wall 212 away from the top portion 211 to form the second balance rooms 215. The second partitions 216 are, for example but not limited to, ribs or cup-like structures. Likewise, the balance object 25 also can be disposed in the second balance room 215 for achieving a dual-plane balance effect. Also for the clear figure, only one balance object 25 disposed in the second balance room 215 is shown, but the invention is not limited thereto.

Figure 6:
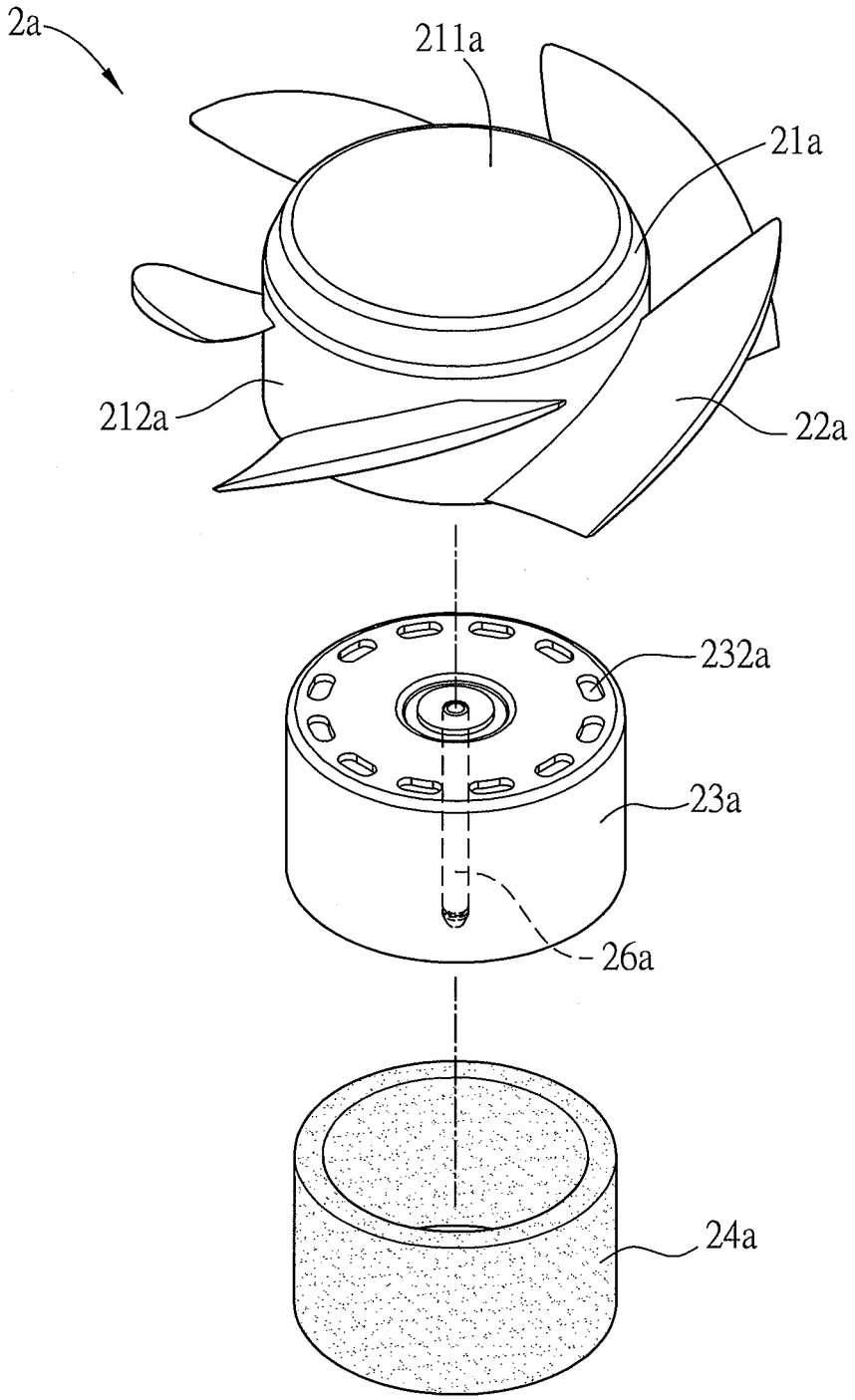
FIG. 6 is an exploded diagram of an impeller of the second embodiment of the invention.
Figure 7:
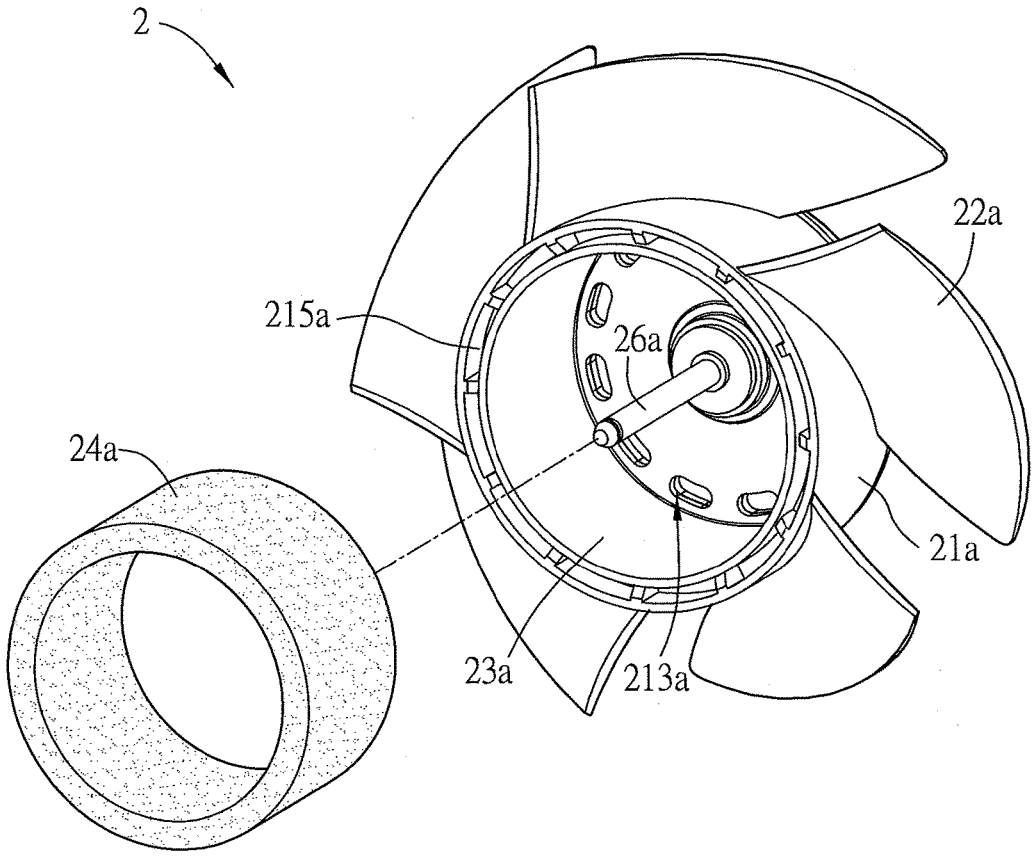
FIG. 7 is a schematic diagram of the hub and the permanent magnet in FIG. 6.
Figure 8:
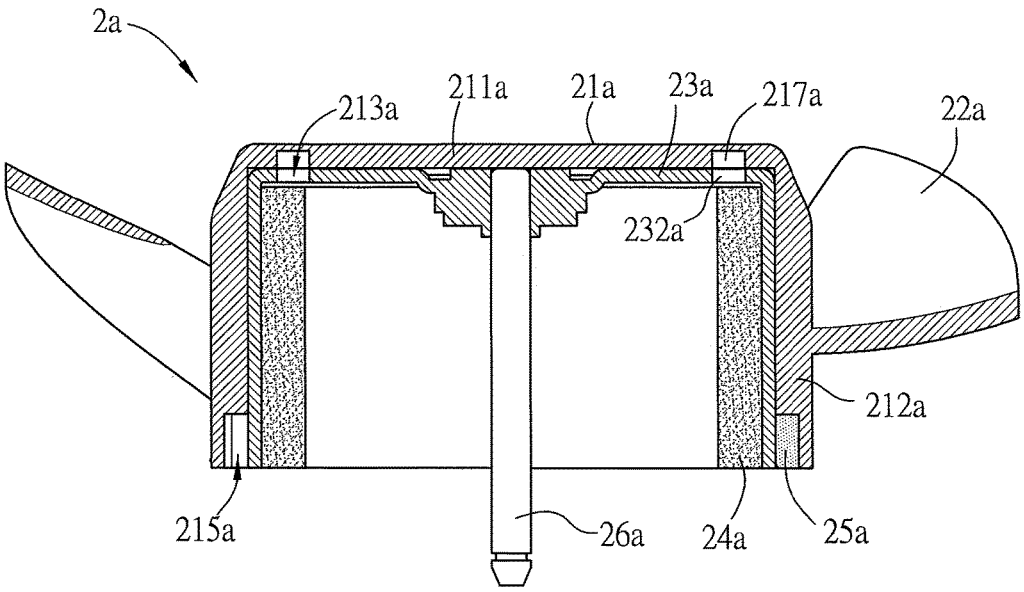
FIG. 8 is a sectional diagram of the impeller in FIG. 6.

FIG. 6 is an exploded diagram of an impeller of the second embodiment of the invention, and FIG. 7 is a schematic diagram of the hub and the permanent magnet in FIG. 6. As shown in FIGS. 6 and 7, the impeller **2*a* includes a hub 21*a*, blades 22 adisposed around the side wall 212*a* of the hub 21*a*, a permeable shell 23*a* disposed within the hub 21*a*, and a permanent magnet 24*a* disposed within the permeable shell 23*a*. The hub 21*a* also includes a plurality of first balance rooms 213*a* formed inside the top portion 211*a* adjacent to the side wall 212*a*. FIG. 8 is a sectional diagram of the impeller in FIG. 6. As shown in FIGS. 6 to 8, the top portion 211*a* includes a plurality of recesses 217*a* which are separately disposed and adjacent to the side wall 212*a*, the permeable shell 23*a* includes a plurality of openings 232***a* corresponding to the recesses 217*a*, and the recesses 217*a* and the openings 232*a* define the first balance rooms 213*a*.

The connection manner between the hub 21*a* and the permeable shell 23*a* is still not limited in this embodiment. For example, they can be integrated as one single piece in a two-material way or assembled together, as long as the recesses 217*a* and the openings 232*a* corresponds to each other to define the first balance rooms 213*a*. In this embodiment, because the first balance rooms 213*a* are formed by the recesses 217*a* and the openings 232*a* separately disposed, the hub 21*a* with a thicker wall can be used and thus the recesses 217*a* can be formed at the top portion 211*a*. Accordingly, the outer edge of the top portion 211*a* of the hub 21*a* is a complete structure without any opening. In comparison with the conventional hub, the hub of the invention can avoid the accumulation of dust and thus the fan's operation can cause a smoother airflow field.

Figure 9:
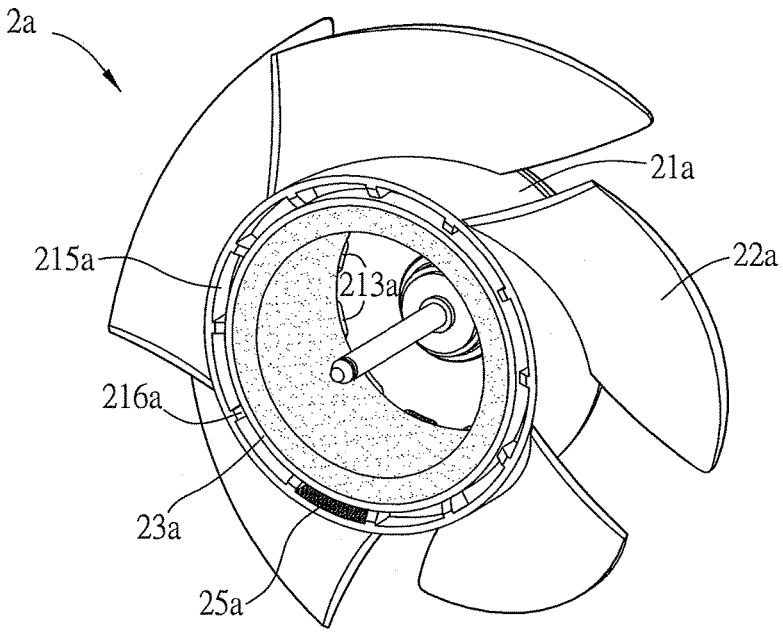
FIG. 9 is a schematic diagram of the impeller in FIG. 6.

FIG. 9 is a schematic diagram of the impeller in FIG. 6. As shown in FIGS. 8 and 9, similar to the first embodiment, the permanent magnet 24*a* is disposed within the permeable shell 23*a*, and at least a portion of the first balance room 213*a* is limited between the top portion 211*a* and the permanent magnet 24*a*. For further achieving a balanced operation of the fan, the impeller 2*a* also can include a balance object 25*a* disposed in the first balance room 213*a*. In this embodiment, the size of the first balance room 213*a* can be adjusted according to the structure of the hub 21*a*. In detail, if the wall thicknesses of the hub 21*a* and permeable shell 23*a* are not sufficient to form the first balance room 213*a* (including the recess 217*a* and the opening 232*a*) that can accommodate the more or bigger balance object 25*a*, the lateral dimension of the recess 217*a* and opening 232*a* can be enlarged, and thereby the first balance room 213*a* is enlarged for accommodating more or bigger balance object 25*a*. Even if the permanent magnet 24*a* is really close to the inner edge of the permeable shell 23*a*, the first balance room 213*a* also can be adjusted in such a way for increasing the capacity thereof.

In this embodiment, because the permanent magnet 24*a* is annularly disposed within the permeable shell 23*a* and partially covers the first balance room 213*a*, the balance object 25*a* disposed in the first balance room 213*a* can be fixed by the permanent magnet 24*a*. Thereby, the balance object 25*a* will not fall off during the fan's operation and thus the stability of the fan's operation can be kept.

Besides, the hub 21*a* further includes a plurality of second balance rooms 215*a* disposed at the end of the side wall 212*a* away from the top portion 211*a*. Similarly, the hub 21*a* further includes a plurality of second partitions 216*a* which are separately disposed at the end of the side wall 212*a* away from the top portion 211*a* to form the second balance rooms 215*a*. The second partitions 216*a* are, for example but not limited to, ribs or cup-like structures. In other embodiments where the wall thickness of the hub is larger, the second balance room can be defined by partitions formed at the inner surface of the hub. However, the invention is not limited thereto. Likewise, the balance object 25*a* also can be disposed in the second balance room 215*a* for achieving a dual-plane balance effect.

Figure 10:
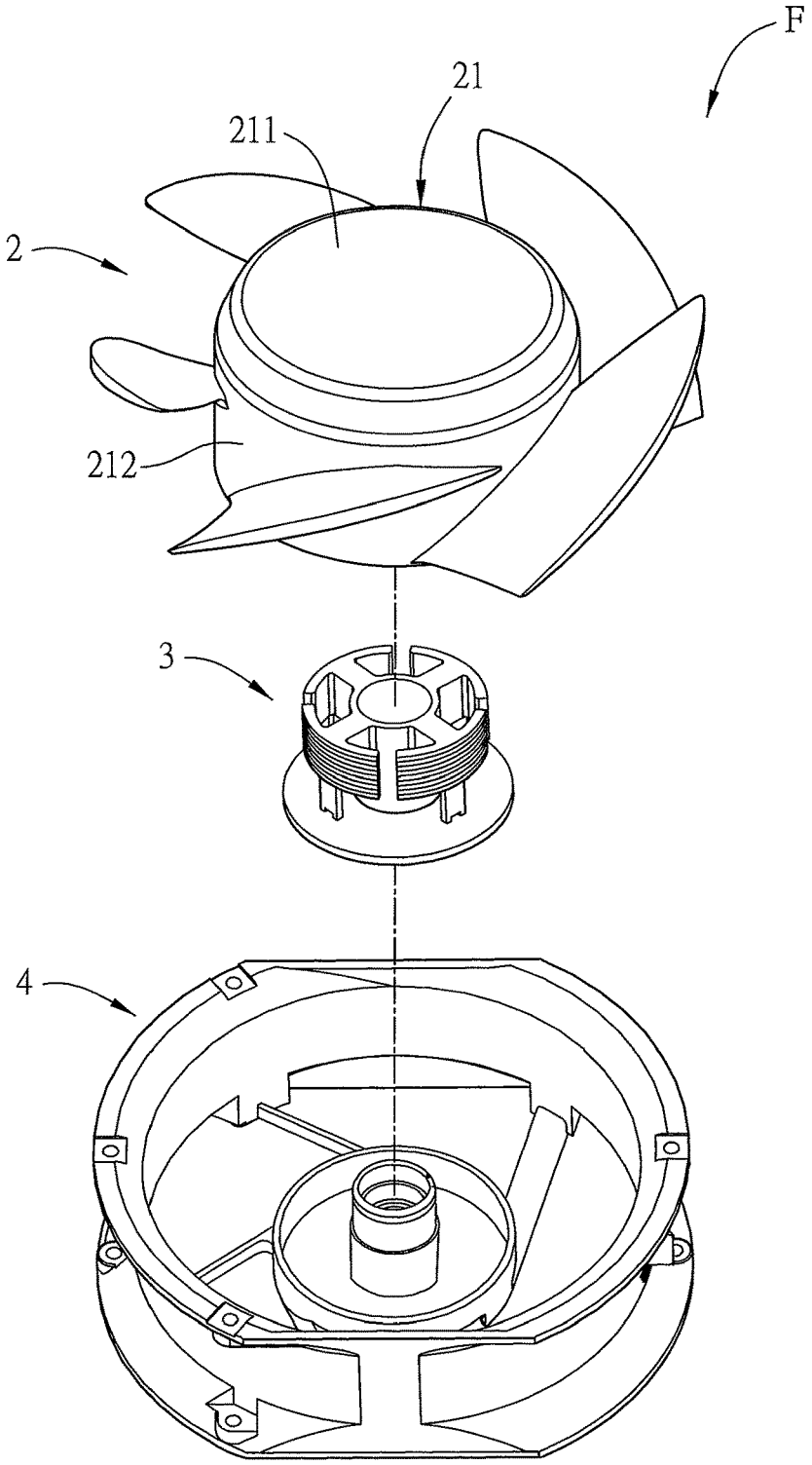
FIG. 10 is an exploded diagram of a fan of the first embodiment of the invention.

FIG. 10 is an exploded diagram of a fan of the first embodiment of the invention. As shown in FIG. 10, the fan F includes an impeller 2, a motor 3 and a frame 4. The impeller 2 and the motor 3 are both received in the frame 4. The motor 3 is connected to the impeller 2 to drive the impeller 2 to rotate. The impeller 2 is taken as an example here, but the impeller 2*a* also can be applied to the fan of this embodiment. As shown in FIGS. 2 to 5, the impeller 2 includes a hub 21, a plurality of blades 22, a permeable shell 23 and a permanent magnet 24. The hub 21 includes a top portion 211 and a side wall 212. The inside of the top portion 211 adjacent to the side wall 212 includes a plurality of first balance rooms 213. The blades 22 are disposed around the side wall 212. The permeable shell 23 is disposed within the top portion 211 and the side wall 212. The permanent magnet 24 is disposed within the permeable shell 23. At least one portion of the first balance room 213 is limited between the top portion 211 and the permanent magnet 24. The impeller 2 further includes a balance object 25, which can be disposed in the first balance room 213 for balancing and enhancing the rotation stability of the impeller 2 while the operation of the fan F. The impeller 2 further includes a shaft 26 coupled to the impeller 2. Other technical features of the fan F and impeller 2 thereof have been clearly illustrated in the above embodiments, and therefore they are not described here for conciseness.

In summary, in the fan and impeller thereof according to the invention, a plurality of first balance rooms are disposed on the inside of the top portion of the hub adjacent to the side wall, and thus hidden inside the top portion of the hub. In comparison with the prior art where the balance rooms are exposed, the accumulation of dust can be avoided in the invention. Besides, the outer surface of the hub is smooth so that the fan's operation can cause a smoother airflow field. Furthermore, the permanent magnet is annularly disposed within the permeable shell and partially covers the first balance room, and thereby the balance object disposed in the first balance room can be retained or secured between the hub and the permanent magnet. So, the balance object will not fall off during the fan's operation and thus the stability of the fan's operation can be kept. Besides, the balance object can be further secured by the disposition of the permanent magnet and the centrifugal force caused by the fan's operation.

In the embodiment where the hub has a thinner wall, the first balance room can be defined by the first partitions, so that the hub and the permeable shell needn't have recesses to form the first balance room. In the case of one-piece structure, only the injection holes are required to be formed at the permeable shell, and therefore the hub and the permeable shell can be kept the structural completeness. In the embodiment where the hub has a thicker wall, the dimensions of the first balance room can be adjusted to get more capacity, and this will not be affected by the position of the permanent magnet.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An impeller comprising:

a hub including a top portion and a side wall, wherein an inside of the top portion adjacent to the side wall includes a plurality of recesses respectively forming a plurality of concave holes, and the plurality of recesses penetrate a depth into the hub;

a plurality of blades disposed around the hub;

a permeable shell including a plurality of through holes passing through the permeable shell on a top surface near a side surface of the permeable shell, wherein the permeable shell is connected to and disposed within the hub, and the plurality of recesses and the plurality of through holes are respectively axially aligned to each other to form a plurality of first balance rooms; and a permanent magnet disposed within the permeable shell, wherein at least a portion of each of the plurality of first balance rooms is defined between the top portion and the permanent magnet.

2. The impeller as recited in claim 1, wherein the hub further includes a plurality of second partitions disposed at an end of the side wall away from the top portion to define at least a second balance room.

3. The impeller as recited in claim 2, further comprising:

a first balance object disposed in at least one of the plurality of first balance rooms and/or at least a second balance object disposed in at least one of the at least a second balance room.

4. The impeller as recited in claim 2, wherein each of the plurality of second partitions is a rib or a concave hole structure.

5. The impeller as recited in claim 1, wherein the hub and the permeable shell are integrated as a single piece by injection molding.

6. The impeller as recited in claim 1, wherein the hub and the permeable shell are assembled together.

7. The impeller as recited in claim 1, wherein the permanent magnet partially covers the plurality of first balance rooms.

8. A fan comprising:

an impeller comprising:

a hub including a top portion and a side wall, wherein an inside of the top portion adjacent to the side wall includes a plurality of recesses respectively forming a plurality of concave holes, and the plurality of recesses penetrate a depth into the hub;

a plurality of blades disposed around the hub;

a permeable shell including a plurality of through holes passing through the permeable shell on a top surface near a side surface of the permeable shell, wherein the permeable shell is connected to and disposed within the hub, and the plurality of recesses and the plurality of through holes are respectively axially aligned to each other to form a plurality of first balance rooms; and a permanent magnet disposed within the permeable shell, wherein at least a portion of each of the plurality of first balance rooms is defined between the top portion and the permanent magnet;

a motor coupled to the impeller for driving the impeller to rotate; and a frame for receiving the impeller and the motor therein.

9. The fan as recited in claim 8, wherein the hub further includes a plurality of second partitions disposed at an end of the side wall away from the top portion to define at least a second balance room.

10. The fan as recited in claim 9, wherein the impeller further includes at least a first balance object disposed in at least one of the plurality of first balance rooms and/or at least a second balance object disposed in at least one of the at least a second balance room.

11. The fan as recited in claim 9, wherein each of the at least one of second partitions is a rib or a concave hole structure.

12. The fan as recited in claim 8, wherein the hub and the permeable shell are integrated as a single piece by injection molding.

13. The fan as recited in claim 8, wherein the hub and the permeable shell are assembled together.

14. The fan as recited in claim 8, wherein the permanent magnet partially covers the plurality of first balance rooms.

* * * * *